US010837202B2

(12) United States Patent
Andersen

(10) Patent No.: US 10,837,202 B2
(45) Date of Patent: Nov. 17, 2020

(54) CHILD SAFETY LATCH

(71) Applicant: Jesper Birk Andersen, Kowloon (CN)

(72) Inventor: Jesper Birk Andersen, Kowloon (CN)

(73) Assignee: Jesper Birk Andersen, Kowloon (CN)

( * ) Notice: Subject to any disclaimer, the term of this patent is extended or adjusted under 35 U.S.C. 154(b) by 587 days.

(21) Appl. No.: 15/620,987

(22) Filed: Jun. 13, 2017

(65) Prior Publication Data

US 2018/0023323 A1 Jan. 25, 2018

(30) Foreign Application Priority Data

Jul. 19, 2016 (GB) ..... 1612488.5

(51) Int. Cl.
*E05B 65/46* (2017.01)
*E05B 65/00* (2006.01)
(Continued)

(52) U.S. Cl.
CPC ..... *E05B 65/0014* (2013.01); *A47B 88/50* (2017.01); *E05B 65/46* (2013.01); *E05C 17/36* (2013.01)

(58) Field of Classification Search
CPC ..... Y10T 292/0894; Y10T 292/095; Y10T 292/0902; Y10T 292/0905;
(Continued)

(56) References Cited

U.S. PATENT DOCUMENTS 493,456 A * 3/1893 Violet ..... E05C 19/14 292/247
1,242,391 A * 10/1917 Ulrich ..... E05C 19/06 292/87
(Continued)

FOREIGN PATENT DOCUMENTS

DE 202016102090 U1 * 6/2016 ..... E05B 65/0014
DE 202017103507 U1 * 7/2017 ..... E05B 65/0014
(Continued)

OTHER PUBLICATIONS

Computer Generated Translation for JP 2005329891, Generated on Nov. 6, 2019, https://worldwide.espacenet.com/ (Year: 2019).*
(Continued)

*Primary Examiner* — Alyson M Merlino
(74) *Attorney, Agent, or Firm* — Fay Sharpe LLP

(57) ABSTRACT

The invention relates to a child safety latch for limiting movement of moveable elements, comprising a prong assembly secured to one element, and an anchor assembly secured to the other element for capturing the terminal end of said prong, said anchor assembly including a receiver to receive and capture said terminal end to stop movement relative movement of the elements by automatic engagement of the receiver of the anchor assembly with the terminal end, the prong assembly being movable by a user between a first position in which the terminal end is captured by the receiver preventing movement of one element with respect to the other element and a second position in which the terminal end is released from the receiver permitting relative movement of the respective elements. The prong is resilient and returns to the first position after release by the user such that when one element is moved back towards the other element, the latch is automatically reactivated such that subsequent movement of one element away from the other element by the specified distance will result in re-engagement of the terminal end and the receiver. The prong assembly preferably includes a strip of resilient metal, and the terminal end of the prong assembly includes an oval shaped opening which corresponds with the receiver which is in the form of a ramp shaped catch on the anchor assembly.

10 Claims, 5 Drawing Sheets

(51) Int. Cl.
*A47B 88/50* (2017.01)
*E05C 17/36* (2006.01)

(58) Field of Classification Search
CPC ..... Y10T 292/0911; Y10T 292/0926; Y10T 292/0928; Y10T 292/0934; Y10T 292/1051; Y10T 292/1061; Y10T 292/17; Y10T 292/34; Y10T 292/37; Y10T 292/394; Y10T 292/397; Y10T 292/0957; Y10T 292/0951; Y10T 292/0952; Y10T 292/0959; Y10T 292/1083; Y10T 292/1084; Y10T 292/1085; Y10T 292/1091; Y10T 292/1092; Y10S 292/65; Y10S 292/61; Y10S 292/38; E05B 65/0014; E05B 65/46; E05B 65/44; E05B 65/02; E05B 2015/0468; E05C 17/36; E05C 17/52; E05C 19/06; E05C 19/10; E05C 19/08; E05C 19/18; E05C 19/184; E05C 19/188; A47B 88/50; A47B 88/53; A47B 88/57; A47B 88/00; A47B 2210/0018
See application file for complete search history.

(56) References Cited

U.S. PATENT DOCUMENTS 1,589,231 A * 6/1926 Rumbold ..... E05F 11/00 292/194
1,646,580 A * 10/1927 Eastman ..... E05C 17/203 16/82
1,819,212 A * 8/1931 Toncray ..... E05C 17/36 16/82
3,061,346 A * 10/1962 Jorgensen ..... E05C 19/066 292/17
3,189,938 A 6/1965 Saunders
3,397,001 A * 8/1968 Friedman ..... E05B 65/0014 292/87
4,378,948 A 4/1983 Chrones
D272,715 S * 2/1984 Bailey ..... D8/330
4,505,526 A 3/1985 Leck
4,632,438 A 12/1986 McKinney
4,707,404 A * 11/1987 Morishita ..... B41M 5/41 400/241
4,715,628 A * 12/1987 Brink ..... E05B 65/0014 292/19
4,717,184 A * 1/1988 Boyce ..... E05B 65/0014 292/262
5,203,620 A * 4/1993 McLennan ..... A47B 88/57 312/334.46
5,262,923 A 11/1993 Batta et al.
5,445,451 A * 8/1995 Harmony ..... E05B 65/0014 292/19
5,645,304 A * 7/1997 Richardson ..... E05B 65/0014 292/1
7,980,605 B1 * 7/2011 Fuhrman ..... E05C 19/182 292/258
2006/0152018 A1 * 7/2006 Crossley ..... E05B 65/0014 292/246
2009/0066203 A1 * 3/2009 Zielinski ..... E05B 65/0014 312/222
2017/0130487 A1 * 5/2017 Andersen ..... E05B 65/44
2019/0032372 A1 * 1/2019 Andersen ..... E05B 65/0014

FOREIGN PATENT DOCUMENTS

GB 2537625 A 10/2016
JP 2005329891 A * 12/2005

OTHER PUBLICATIONS

UK Search Report of Application Serial No. GB 1612488.5 dated Jan. 12, 2017, 1 page.

* cited by examiner

CHILD SAFETY LATCH

REFERENCE TO RELATED APPLICATION

This application claims priority to and the benefit of UK patent application GB1612488.5, filed Jul. 19, 2016 and entitled "A Child Safety Latch", the entirety of which is hereby incorporated by reference.

BACKGROUND

To prevent unwanted opening of cabinet drawers, it is known to provide rearwardly or forwardly extending drawer safety catches which allow for limited opening of a drawer but which require manual disengagement so as to permit a drawer to be fully opened. Safety catches are typically used in the home to prevent unwanted opening of drawers and cabinet doors by small children. Such catches typically are mounted to an interior surface of a cabinet drawer or to an edge of a door of the cabinet, and include a hook or latch which engages a corresponding catch on the cabinet housing when the drawer or door is being closed. During opening of the drawer or door, the latch engages the catch after the door is opened to a limited extent. To permit further opening of the drawer or door to a fully open position which allows access to the contents of the cupboard or drawer, a user manually actuates the latch to a position disengaged from the catch such that the drawer or door can be freely opened. Adults and older children can actuate the safety latch without great difficulty, although such latches, particularly in the home, cause greater difficulty for a small child such that the small child is prevented from opening the drawer or door to gain access to potentially harmful products and articles contained therein.

In one known drawer catch as disclosed in U.S. Pat. No. 4,505,526, a flexible hooked element is mounted to and projects rearwardly from a front wall of a drawer into the interior thereof. The hooked element is positioned to engage a catch on a downward facing surface of the cabinet which overlies the drawer. The drawer can be opened a limited amount until the hook engages the catch, at which time the user must manually flex the hook downwardly to disengage the catch. In this arrangement, the hook extends into the interior of the drawer such that it may interfere with access to the drawer interior as well as interfere with the contents thereof.

Additional latching mechanisms are also disclosed for securing a structure within a housing, although these latches do not operate as safety catches which allow limited movement of the structure, much less safety latches that can be readily mounted at various locations on a drawer with a minimum of difficulty. For example, U.S. Pat. No. 3,189,938 discloses a pair of handles which each have a latch mechanism at upper and lower ends thereof and project through a front face of a drawer to secure the drawer in a fully closed position. Each drawer latch is mounted to a single location on the drawer and requires that the latch mechanism extend through the front panel of the drawer for operation thereof.

In another example, U.S. Pat. No. 5,262,923 discloses a latching mechanism for securing a computer disc drive in a disc housing. This latch mechanism engages an aperture formed in the housing adjacent a front edge thereof and fixedly secures the computer disc drive in a single position. The latch extends from an elongate slide rail by which the disc drive is supported in the housing. The latch mechanism is not detachable from the support rail. When engaged with the housing, the latch mechanism only defines a single secured position for the disc drive so as to prevent both forward and rearward movement of the disc drive relative to the housing.

SUMMARY

It is an object of the invention to provide a child safety latch which is readily mountable and demountable at various locations on exterior surfaces of existing drawers so as to prevent unwanted opening of drawers and cabinets by small children. It is a further object that the drawer catch be readily releasable when operated by older children and adults. It is a further object of the invention that the catch does not break so that failure of the catch does not result in a drawer or cabinet being accessible to small children when it is believed by responsible adults to be safe.

According to the invention here is provided a child safety latch for limiting movement of a first element with respect to a second element, said latch comprising in combination:

a prong assembly secured to the first element, said prong assembly including a terminal end;

an anchor assembly secured to the second element for capturing the terminal end of said prong said anchor assembly including a receiver to receive and capture said terminal end to stop movement of the first element with respect to the second element;

the movement of the first element with respect to the second element is stopped when the first element has moved a specified distance from the second element; by automatic engagement of the receiver of the anchor assembly with the terminal end, the prong assembly being movable by a user between a first position in which the terminal end is captured by the receiver preventing movement of the first element with respect to the second element and a second position in which the terminal end is released from the receiver permitting movement of the first element with respect to, and further away from, the second element; and the prong is resilient and returns to the first position after release by the user such that when the first element is moved back towards the second element, the latch is automatically reactivated such that subsequent movement of the first element away from the second element by the specified distance will result in re-engagement of the terminal end and the receiver, characterised in that the prong assembly includes a strip of resilient metal.

The terminal end of the prong assembly may include an oval shaped opening which corresponds with the receiver which is in the form of a ramp shaped catch on the anchor assembly. Preferably the prong assembly comprises a first leg which is attached to the second element and a second leg comprising the terminal end, which extends in the direction of movement of the first element.

Preferably the strip of resilient metal comprises a first metal leg and a second metal leg which extends in the direction of movement of the first element.

The prong assembly may comprise a first component being of moulded plastic and a second component being the strip of resilient metal. Preferably the first plastic component comprises a recess in which the resilient metal strip is located.

The first metal leg of the resilient metal strip may be affixed to a first leg of the first plastic component and the second leg of the metal strip is attached to the second leg of the first plastic component, such that when the prong is moved by the user from the first position, the metal strip provides substantial part of the returning force returning the prong assembly back to the first position when released.

Preferably the prong assembly is manufactured by insert moulding of the first plastic component and second resilient metal strip component together.

The metal strip may comprise a lip extending towards the first plastic component and corresponding to a receiving portion of the first plastic component and serving to fixedly attach the non-flexing portion of the metal strip to the first plastic component. The metal strip may have a further flange portion which forms a second side of a generally U shaped grip, with the lip forming the first side of the generally U-shaped grip, the generally U-shaped grip corresponding to a respectively dimensioned portion of the first leg of the plastic component, so that the U-shaped grip fixedly attaches to the first leg portion, securely attaching the metal strip to the plastic component to form the prong assembly.

The prong assembly is preferably attached to the first element by means of a prong assembly attachment which is secured to the first element and comprises a recess into which the first leg of the prong assembly is inserted to secure to the prong assembly attachment and thus to the first element.

The strip of resilient metal may be made of spring steel.

The latch may be a cabinet latch with the second element part of a cabinet frame and the first element a cabinet door.

The latch may be a drawer latch and the second element part of the drawer chest frame and the first element a drawer.

BRIEF DESCRIPTION OF THE DRAWINGS

An embodiment of the invention will now be described with reference to the following figures in which.

DETAILED DESCRIPTION

Figure 1:
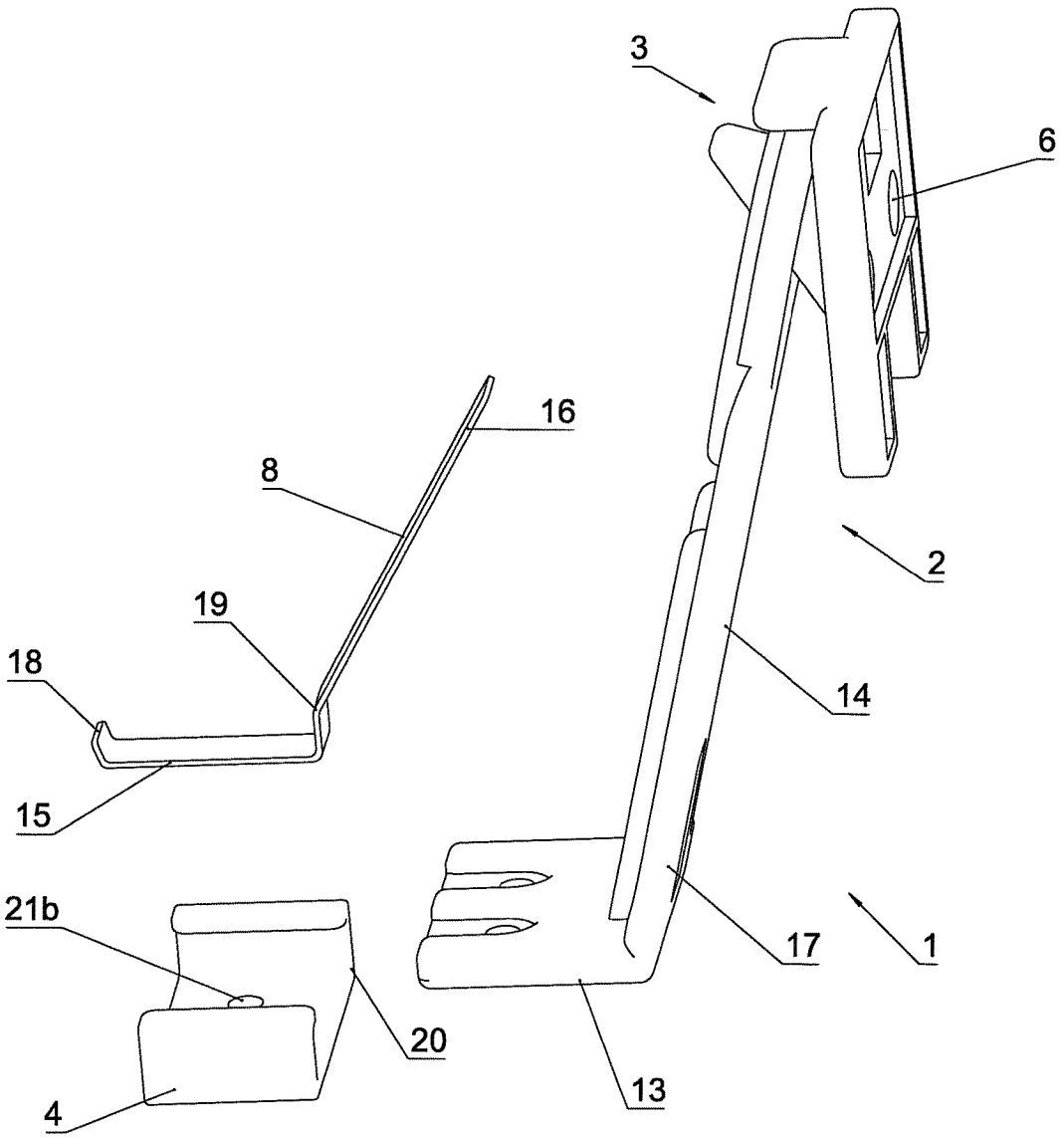
FIG. 1 is a sideways general assembly perspective view of the child safety latch of the embodiment of the invention showing the components separated.
Figure 2:
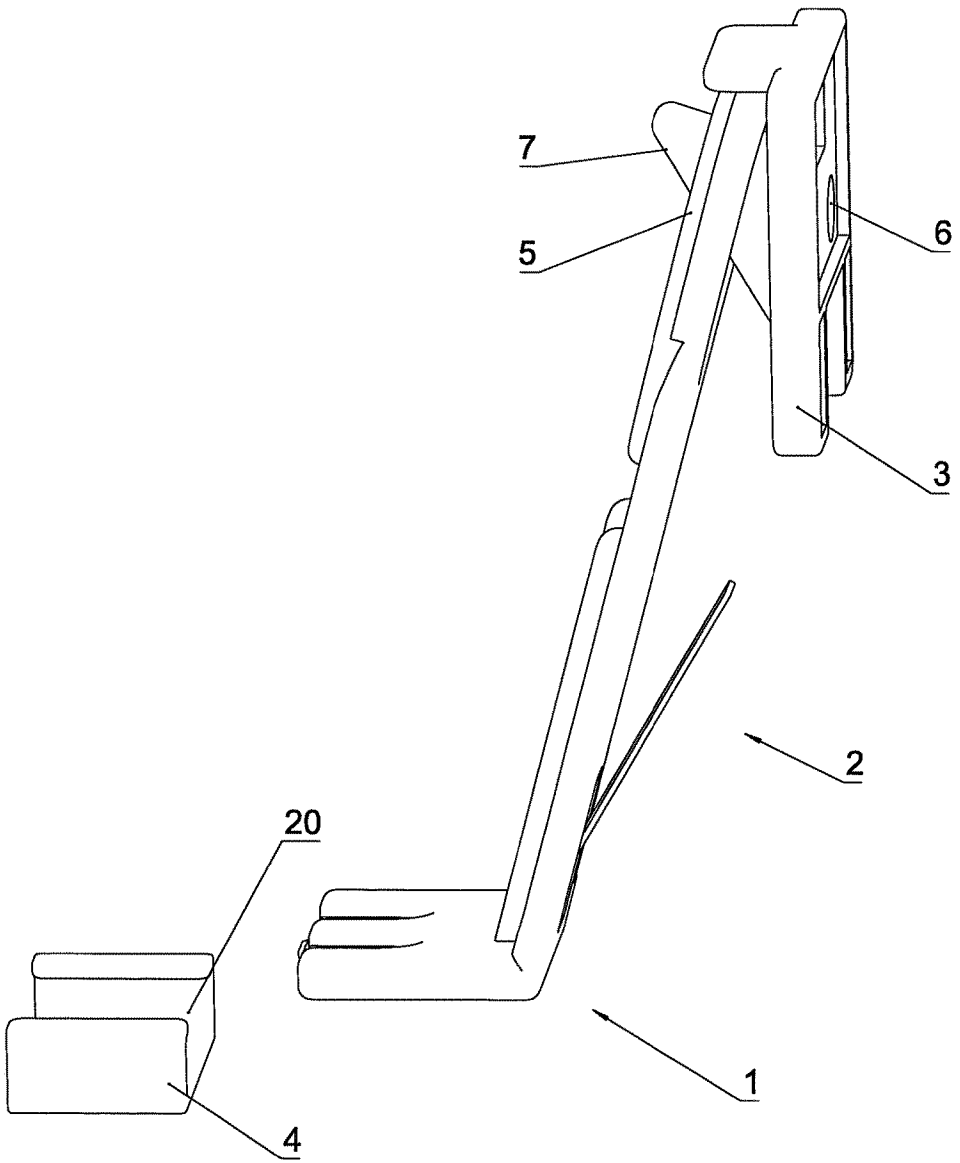
FIG. 2 is a sideways perspective view of the latch of FIG. 1 showing the latch assembled in an unfitted position.
Figure 3:
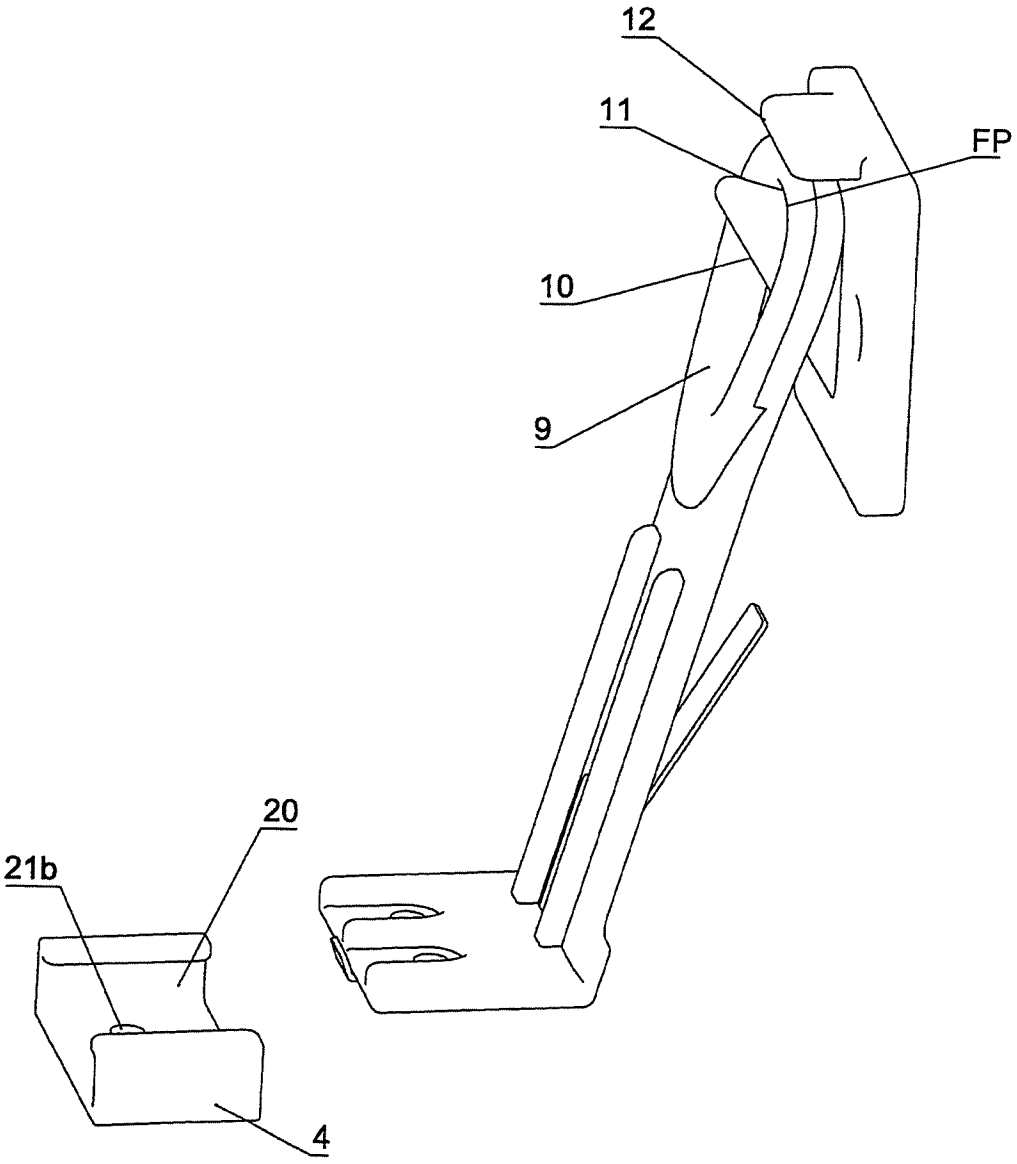
FIG. 3 is an underside perspective view of the latch of FIG. 1 showing the latch assembled in an unfitted position.
Figure 4:
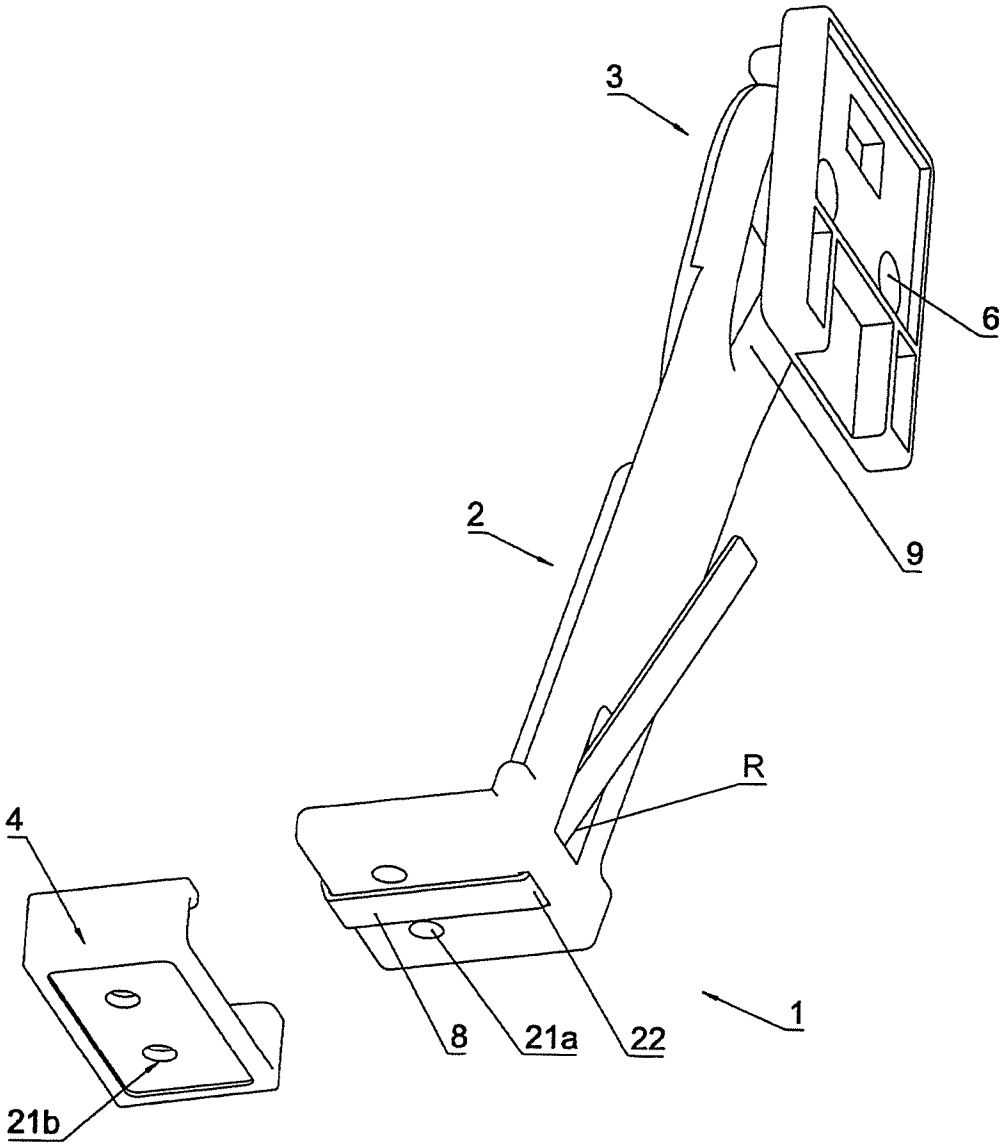
FIG. 4 is an upperside perspective view of the latch of FIG. 1 showing the latch assembled in an unfitted position.
Figure 5:
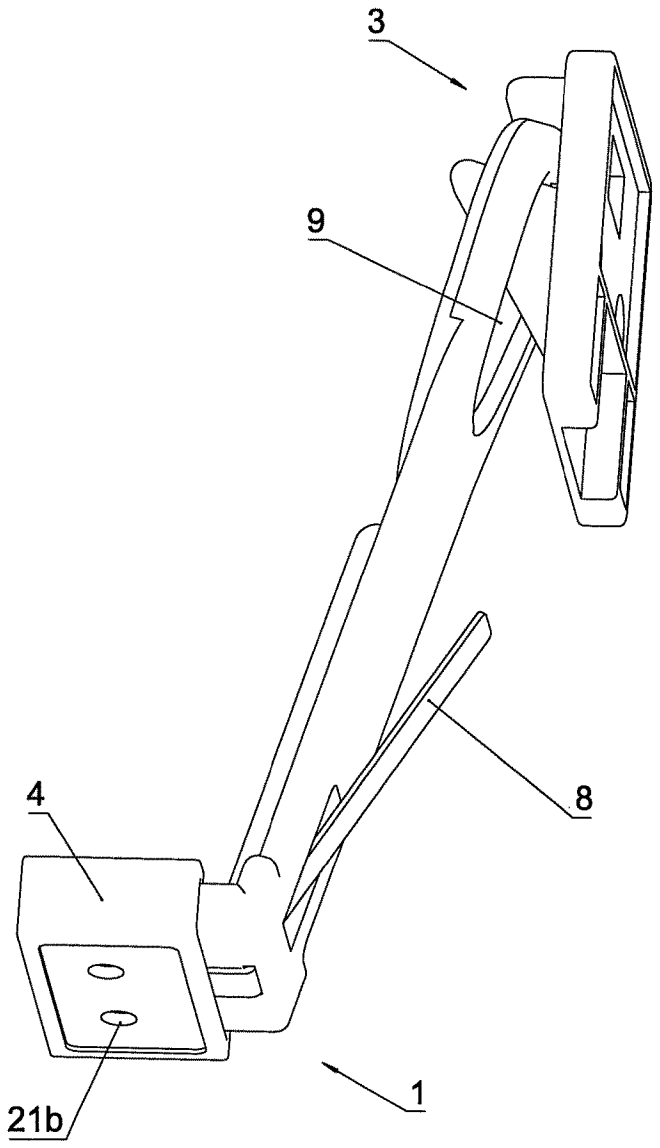
FIG. 5 is an upperside perspective view of the latch of FIG. 1 showing the latch assembled in a fitted position.

Referring to FIGS. 1 to 5, there is shown a child safety latch 1 for limiting movement of a first drawer or door element (not shown) with respect to a second cabinet frame element (not shown). The latch 1 comprises a prong assembly 2 and an anchor assembly 3. The prong assembly 2 is secured to the first element, by means of attaching means 4 and at the opposite end of the prong assembly there is a terminal end 5.

The anchor assembly 3 is secured to the second element by means of suitable fixing means such as adhesive or screws through screw holes 6, or by both adhesive and screws. The anchor assembly 3 includes a receiver 7 to receive and capture the terminal end 5 which stops movement of the first element with respect to the second element.

The movement of the first element with respect to the second element is stopped when the first element has moved a specified distance from the second element; by automatic engagement of the receiver 7 of the anchor assembly 3 with the terminal end 5. The specified distance being approximately the length of the prong assembly 2.

The prong assembly 2 forms a cantilever arm and is movable by a user between a first position in which the terminal end 5 is captured by the receiver 7 preventing movement of the first element with respect to the second element and a second position in which the terminal end 5 is released from the receiver 7 permitting movement of the first element with respect to, and further away from, the second element.

The prong assembly 2 is resilient and returns to the first position after release by the user such that when the first element is moved back towards the second element, the latch is automatically reactivated such that subsequent movement of the first element away from the second element by the specified distance will result in re-engagement of the terminal end 5 and the receiver 7.

The terminal end 5 of the prong assembly 2 includes an oval shaped opening 9 which corresponds with the receiver 7. The receiver 7 is in the form of a ramp shaped catch on the anchor assembly 3 with a shallowly inclined ramp 10, an acute-angled return edge 11 and a stop 12. The oval opening 9 is formed at its terminal end by a front portion FP. As the first element is moved away from the second element, as would happen when opening a drawer or door, the prong assembly and the anchor assembly are so aligned when fitted that the front portion FP follows the inclined ramp 10. The resiliency of the prong assembly 2 causes the front portion FP to ride over the acute-angled return edge 11 and come to rest in between the acute-angled return edge 11 and the stop 12 so preventing further movement.

The prong assembly 2 comprises an elongate component 17 moulded of plastic material comprising a first leg 13 which is attached to the first element and a second leg 14 comprising the terminal end, which extends in the direction of movement of the first element.

The prong assembly 2 also includes a strip of spring steel 8 which also comprises a corresponding first spring leg 15 and a second spring leg 16 which extends generally in the direction of movement of the first element.

The spring strip 8 is located in a recess R in the plastic component 17 such that the second spring leg 16 extends along the second leg 14 of the plastic component 17 to provided added spring returning force to the prong assembly 2. This location of the spring steel strip in the plastic component 7 to form the prong assembly also provides additional strength and durability to the prong assembly and prevents failure of the latch during a long period of continued use and thus prevents situation where the latch breaks and does not perform its intended function. This reduces the risk of unintended access by children in the event of a latch failure that goes undetected by a responsible adult.

The prong assembly 2 may be manufactured by insert moulding of the plastic component 17 and spring steel strip 8 together.

The spring steel metal strip 8 comprises a lip 18 starting at the fixing end of the prong assembly and extending back towards terminal end 5, and an opposite flange portion 19 which form a shallow generally U-shaped grip. The generally U-shaped grip corresponds to a respectively dimensioned portion of the first leg 13 of the plastic component 17, so that the generally U-shaped grip fixedly attaches to the first leg 13, securely attaching the spring steel strip 8 to the plastic component 17 to form the prong assembly 2.

The prong assembly 2 is preferably attached to the first element by means of a prong assembly attachment 4 which is secured to the first element and comprises a recess 20 into which the first leg 13 of the prong assembly is inserted. The prong assembly attachment 4 allows the prong assembly 2 to be attached to the first element more easily during fitting. To fit the latch, the anchor assembly 3 is fitted to the second element first on its own, then the prong assembly is engaged as if in the stopped position so that the prong attaching end can be fixed in the correct alignment. The prong assembly 2 and prong assembly attachment means 4 have aligned screw holes 21*a*, 21*b*, which permit the screw locations to be marked or piloted or temporarily fixed with adhesive on the first element whilst the first leg 13 is located in the recess 20, then the first leg 13 is removed from the recess which permits the user to easily secure the attachment 4 with screws without the hindrance of the prong assembly, and after the screws have been fitted the first leg is re-inserted into the recess and the installation is complete.

The latch may be a cabinet latch with the second element part of a cabinet frame and the first element a cabinet door, or alternatively the latch may be a drawer latch and the second element part of the drawer chest frame and the first element a drawer.

COMPONENT LIST

1—Child Safety Latch
2—Prong Assembly
3—Anchor Assembly
4—Attaching Means
5—Terminal End
6—Screw Holes
7—Receiver
8—Spring Steel Strip
9—Oval Shaped Opening
10—Inclined Ramp
11—Acute-Angled Return Edge
12—Stop
13—First Leg
14—Second Leg
15—First Spring Leg
16—Second Spring Leg
17—Plastic Component
18—Lip
19—Opposite Flange Portion
20—Recess
21—Screw Holes (21*a* and 21*b*)
22—Lip Recess

The invention claimed is:

1. A child safety latch for limiting movement of a first element with respect to a second element, said latch comprising:

a prong assembly secured to the first element, said prong assembly including a terminal end;

an anchor assembly secured to the second element for capturing the terminal end of said prong assembly, said anchor assembly including a receiver to receive and capture said terminal end to stop movement of the first element with respect to the second element;

the movement of the first element with respect to the second element is stopped when the first element has moved a specified distance from the second element; by automatic engagement of the receiver of the anchor assembly with the terminal end, the prong assembly being movable by a user between a first position, in which the terminal end is captured by the receiver preventing movement of the first element with respect to the second element, and a second position, in which the terminal end is released by a user from the receiver permitting movement of the first element with respect to, and further away from, the second element; and the prong assembly is resilient and returns to the first position, after the terminal end is released from the receiver by the user such that when the first element is moved back towards the second element, the latch is automatically reactivated such that subsequent movement of the first element away from the second element by the specified distance will result in re-engagement of the terminal end and the receiver, wherein the prong assembly includes a strip of resilient metal;

wherein the prong assembly comprises a first component being of molded plastic and a second component being the strip of resilient metal;

wherein the strip of resilient metal comprises a lip extending towards the first molded plastic component and corresponding to a receiving portion of the first molded plastic component and serving to fixedly attach a non-flexing portion of the strip of resilient metal to the first molded plastic component; and wherein the strip of resilient metal further has a flange portion, which forms a second side of a generally U-shaped grip, with the lip forming a first side of the generally U-shaped grip, the generally U-shaped grip corresponding to a respectively dimensioned portion of a first leg of the first molded plastic component, so that the generally U-shaped grip fixedly attaches to the first leg, securely attaching the strip of resilient metal to the first molded plastic component to form the prong assembly.

2. A child safety latch according to claim 1, wherein the terminal end of the prong assembly includes an oval shaped opening which corresponds with the receiver, which is in the form of a ramp shaped catch on the anchor assembly.

3. A child safety latch according to claim 1, wherein the prong assembly comprises a first leg, which is attached to the first element, and a second leg comprising the terminal end, which extends in a direction of movement of the first element.

4. A child safety latch according to claim 1, wherein the strip of resilient metal comprises a first metal leg and a second metal leg, which extends in a direction of movement of the first element.

5. A child safety latch according to claim 4, wherein the strip of resilient metal is made of spring steel.

6. A child safety latch according to claim 1, wherein the first molded plastic component comprises a recess in which the strip of resilient metal is located.

7. A child safety latch according to claim 1, wherein a first metal leg of the strip of resilient metal is affixed to a first leg of the first molded plastic component and a second leg of the strip of resilient metal is attached to the second leg of the first molded plastic component, such that when the terminal end of the prong assembly is released from the receiver by movement of the prong assembly from the first position to the second position by the user, the strip of resilient metal provides part of a returning force, returning the prong assembly back to the first position.

8. A child safety latch according to claim 1, wherein the prong assembly is attached to the first element by means of a prong assembly attachment, which is secured to the first element and comprises a recess into which a first leg of the prong assembly is inserted to secure to the prong assembly attachment and thus to the first element.

9. A child safety latch according to claim 1, wherein the latch is a cabinet latch and the second element is a part of a cabinet frame and the first element is a cabinet door.

10. A child safety latch according to claim 1, wherein the latch is a drawer latch and the second element is a part of a drawer chest frame and the first element is a drawer.

* * * * *